US005820231A

United States Patent [19]

Schön

[11] Patent Number: 5,820,231

[45] Date of Patent: Oct. 13, 1998

[54] TOWEL DISPENSER FOR ROLL TOWELING

[75] Inventor: Ralph Schön, Bühlerzell, Germany

[73] Assignee: Erich Schumm GmbH, Murrhardt, Germany

[21] Appl. No.: 765,241

[22] PCT Filed: Jun. 22, 1995

[86] PCT No.: PCT/EP95/02438

§ 371 Date: Dec. 19, 1996

§ 102(e) Date: Dec. 19, 1996

[87] PCT Pub. No.: WO96/00516

PCT Pub. Date: Jan. 11, 1996

[30] Foreign Application Priority Data

Jun. 28, 1994 [DE] Germany ..... 44 22 182.7

[51] Int. Cl.[6] ..... B65H 19/00

[52] U.S. Cl. ..... 312/34.11; 312/34.9

[58] Field of Search ..... 312/34.1, 34.8, 312/34.9, 34.11

[56] References Cited

U.S. PATENT DOCUMENTS

| | | | |
|---|---|---|---|
| 2,172,482 | 9/1939 | Steiner et al. | 312/38 |
| 2,229,327 | 1/1941 | Hepner et al. | 312/38 |
| 2,849,268 | 8/1958 | Kirkell | 312/38 |
| 3,853,363 | 12/1974 | Frederiksen | 312/34.11 |
| 3,858,951 | 1/1975 | Rasmussen | 312/38 |
| 3,971,607 | 7/1976 | Schnyder | 312/38 |
| 4,848,854 | 7/1989 | Kennedy | 312/38 |
| 4,999,611 | 3/1991 | Zehnder, Jr. | 312/34.11 X |
| 5,184,885 | 2/1993 | Arabian et al. | 312/34.11 |
| 5,244,263 | 9/1993 | Kennedy | 312/34.11 |

FOREIGN PATENT DOCUMENTS

| | | |
|---|---|---|
| 45486/72 | 8/1972 | Australia . |
| 0 059 893 | 9/1982 | European Pat. Off. . |

OTHER PUBLICATIONS

German Search Report in P 44 22 182.7, dated Jan. 20, 1995.
PCT Search Report in PCT/EP95/02438, dated Nov. 2, 1995.

*Primary Examiner*—Peter R. Brown
*Assistant Examiner*—Stephen Vu
*Attorney, Agent, or Firm*—Quarles & Brady

[57] ABSTRACT

In a dispenser (1) a dispensing mechanism (18) and a take-up mechanism (19) are arranged on a single side of a removable unit (20) so that an energy storage driven by dispensing is also not discharged even when the cabinet is opened, that the take-up can also be set in motion even when the full, predetermined dispensing length has not been dispensed, that take-up is possible both with and without timing control or the dispensing length can be limited and that a precisely limited return of the toweling loop, opposing the take-up, is possible at the soiled side, as a result of which highly versatile functions materialize for a compact configuration.

32 Claims, 5 Drawing Sheets

TOWEL DISPENSER FOR ROLL TOWELING

TECHNICAL FIELD AND BACKGROUND OF THE INVENTION

The invention relates to a towel dispenser, particularly for hand-drying.

There is the need in towel dispensing for the loop or the like exposed for use, connecting the clean portion to the soiled portion of the toweling web and permitting subsequent incremental dispensing, to be taken up or shortened and thus make it ready for permitting dispensing of a fresh towel portion in extending the length of the loop, whereby the loop may hang down non-tensioned for a predetermined time or may be continuously subjected to the tension of a take-up force so that after being released by the user it is immediately taken up.

OBJECTS OF THE INVENTION

The invention is based on the object of defining a towel dispenser in which the disadvantages of known configurations are avoided and which, more particularly, offers the possibility of ensuring an effective take-up in many of its different operating conditions and/or to permit simple handling.

SUMMARY OF THE INVENTION

In accordance with the invention the toweling web can be dispensed from a clean storage and, depending thereon, transferred into one or more soiled storages, towel dispensing expediently operating a toweling take-up, a loop take-up and/or an energy storage, the stored energy of which serves to tensioningly pull the loop to the dispenser, e.g. on timeout of a timer, or to take over a soiled portion of the toweling loop into the final soiled storage. The timeout of the timer may commence during or after dispensing of the clean toweling portion to the loop.

Preferably, the energy storage is charged manually or by pulling-down the toweling web so that it always contains sufficient energy, irrespective of the operating condition of the dispenser, to take up the loop or to transfer the last trailing end of the toweling web totally into the cabinet. Such an operating condition may also be the one which is provided for extracting the soiled toweling web or for inserting a fresh toweling web or it may be the one resulting when the last end of the clean toweling web is totally taken up or transferred into the soiled storage, namely e.g. wound up. Expediently, the energy storage for each towel dispensing action is charged so that the energy stored thereby is sufficient for taking up a length of toweling web which is at least 10% greater than the toweling web length dispensed immediately before.

To prevent overcharging of the energy storage thereby, e.g. a mechanical spring storage having a tensioned storage spring, expediently an overtensioning safeguard is provided. In the case of a spiral spring at least one end may be defined by friction only, so that it is moved on loading with respect to the input/or output drive transfer member connected thereto, thus making a further tensioning of the spring no longer possible whilst, however, retaining the maximum possible spring tension.

To avoid take-up or to retain the stored energy or in corresponding operating conditions, the energy storage or the take-up mechanism is expediently blocked from outputting energy. If, e.g. the take-up mechanism is not subjected to the holding effect by the toweling web, expediently a corresponding blocking action is engaged. For this purpose a sensing or strobe member may be provided which senses the presence of the toweling web upstream of the soiled storage or of a drivable take-up roller in a passage slot or downstream of the intake position of the associated loop leg into the dispenser and, when not present, to engage the blocking. The sensing member may, however, also sense the operating status of the dispenser mechanically, namely e.g. whether both slot limits in the using position are closely located together or separated from each other e.g. so that the toweling web can be replaced, i.e. in this case too, a blocking being provided. As a result of this the energy storage is discharged neither when the toweling web is totally taken up nor when the dispenser is opened so that after having inserted a fresh toweling web sufficient driving energy is still available to retrieve the free end of the toweling web after it having being sensed as being sufficient with respect to the take-up without one or multiple lengths of toweling web needing to be pulled out from the clean storage for this purpose so as to charge the energy storage ready for operation.

The blocking means is expediently provided separate from the locking means which is released by the timing member so that the take-up mechanism is set in movement. Both means may, however, affect the same rotor, e.g. a vaned rotor braked by air resistance which is driven via a multistage gearwheel assembly by the energy storage at a running speed which is many times higher with respect to the latter.

For limiting the dispensing length of the toweling web from the clean and/or soiled storage on each dispensing cycle limiting means are expediently provided acting positively to advantage by a stop and is engaged either by an actuating member of the timing control or by a separate control member cooperating with the dispensing action. As a result of this the dispenser may be directly changed over from a timed control to a non-delayed control and vice-versa or the timing member can be arranged or omitted without this having any influence on the limiting effect. A locking member affecting blocking, movable between an engaged and a disengaged position, comprises expediently separate cams, on the one hand, for operation by a switching member of the timing member and, on the other for actuating by the control member, e.g. a roller, whereby the second-mentioned cam may form directly also the stop. Expediently the advance locking means for the engaging or stop position is automatically positively controlled, whilst for the disengaged position it is translated into the disengaged position by a force, particularly by a force of the weight of the corresponding cam being released.

The cited functions presuppose, as a rule, the implementation of a predetermined, stop-limited dispensing actuating travel of the control member or the like, namely that a relatively precisely predetermined length of the toweling web is dispensed. If the actual actuating travel less than the cited dispensing actuating travel a cam engaging the timing member or the locking means in the region of the associated cam follower may remain motionless instead of overrunning the latter and thus prevent a disengagement of this member, as a result of which the take-up is not motivated or a further dispensing action prevented. To prevent this, disengaging means are provided which also permit resetting or disengagement of the cited member even when the cam follower engages or stands in the way of the control cam.

The cam follower is positively locked dimensionally in its working position, but is releasable by a movement transversely to its control movement, this release taking place automatically so that the control cam at the end of its actuating travel is set back by tensioning forces in the take-up mechanism against its working direction by a small amount of its travel so that as a result of this the cam follower is taken along by friction contact into its disengaged position in which it can be moved against the spring force away from the cam with respect to the switching member. The switching member or the locking member can then be disengaged, despite the cam follower being in contact with the cam follower, the latter is automatically translated into its working position by spring force and locked therein. The cited return movement or disengagement action may be driven in a simple manner by the energy storage or its drive member when the latter is drivingly connected to the control member and via the cam to the cam follower for charging the energy storage. To limit towel return travel positively by dimension a freewheel lock is provided which releases the necessary return travel e.g. by the backlash of a return locking member.

It is particularly of advantage when the clean space is located at least partly to substantially completely above the used or soiled space and the clean space extends approximately up to the upper side of the dispenser cabinet or the soiled space approximately up to the bottom side of the dispenser cabinet. As a result of this all essential mechanical or movable function parts of both the dispensing mechanism and the take-up mechanism and their connection can be provided in the lowest region of the dispenser or beneath the clean space. Furthermore the clean space or the toweling web located therein can hardly be contaminated by the soiled space. A partition between these two spaces further improves this effect. Advantageously, this partition takes the weight of the stored clean toweling portion, it being loaded by a spring or the like against the force of this weight so that with the reduction of the weight of the clean storage it cancels this force substantially incrementally, thus creating room for the increase in or growth in the soiled storage. As a result of this the overall height of the dispenser can be selected substantially smaller than the sum of the maximum height of both spaces. The toweling web can be guided in a slotted chute from the clean space up to the loop with respect to the soiled storage or used space substantially completely so that also this portion of the toweling web is not contaminated.

For facilitated maintenance of the dispenser or for changing the toweling web the corresponding space is to be opened approximately over its full height or at its side facing away from the other space and at the front side substantially completely over its full facing width, more particularly without having to totally remove cabinet parts. The mounting of the cabinet or closure parts movable for this purpose is advantagously provided, on the one hand, in the frontmost and lowermost region of the dispenser or, on the other, in the topmost and rearmost region, whereby in the lower region or in the frontmost third or quarter of the dispenser two swivel axes located one above the other may be provided, on the one hand, for the screening and, on the other, for a sole bottom hinged panel. As a result of this the winding shaft for the used storage, after having been connected to the frontmost end of the towel in forming a loop, can be inserted from underneath upwards into the dispenser and following total winding up of the soiled toweling web be removed from the front side of the dispenser.

The towel take-up is able to directly wind the soiled toweling web or, however, deposit it unwound loosely in an buffer storage before winding it up as a function of the next dispensing movement. In the first case the take-up roller driven by the energy storage directly drives the used roll at its outer circumference, whilst in the second case the take-up roller is provided separate from a drive roller for the used roll. The buffer storage is preferably provided on the bottom of the dispenser so that it is surrounded by the toweling loop. In the buffer storage the toweling web is able to dry, particularly when the associated receiving space is aired by opposing openings in its walls located above each other and/or on the side by convection or the like.

These and further features are evident not only from the claims but also from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

An example embodiment of the invention is explained in more detail in the following and illustrated in the drawings in which.

DETAILED DESCRIPTION

Figure 1:
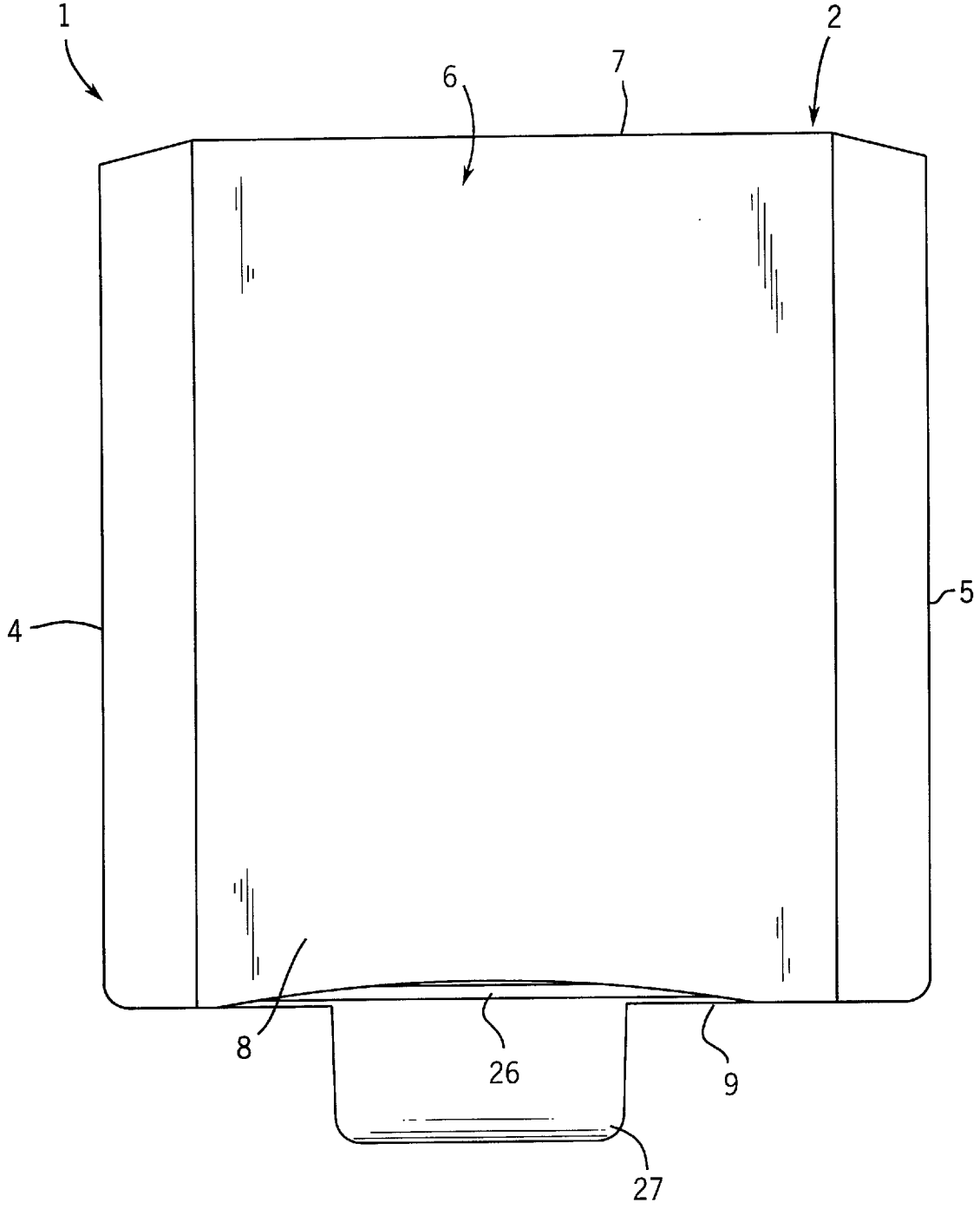
FIG. 1 is a front view of the towel dispenser according to the invention.
Figure 2:
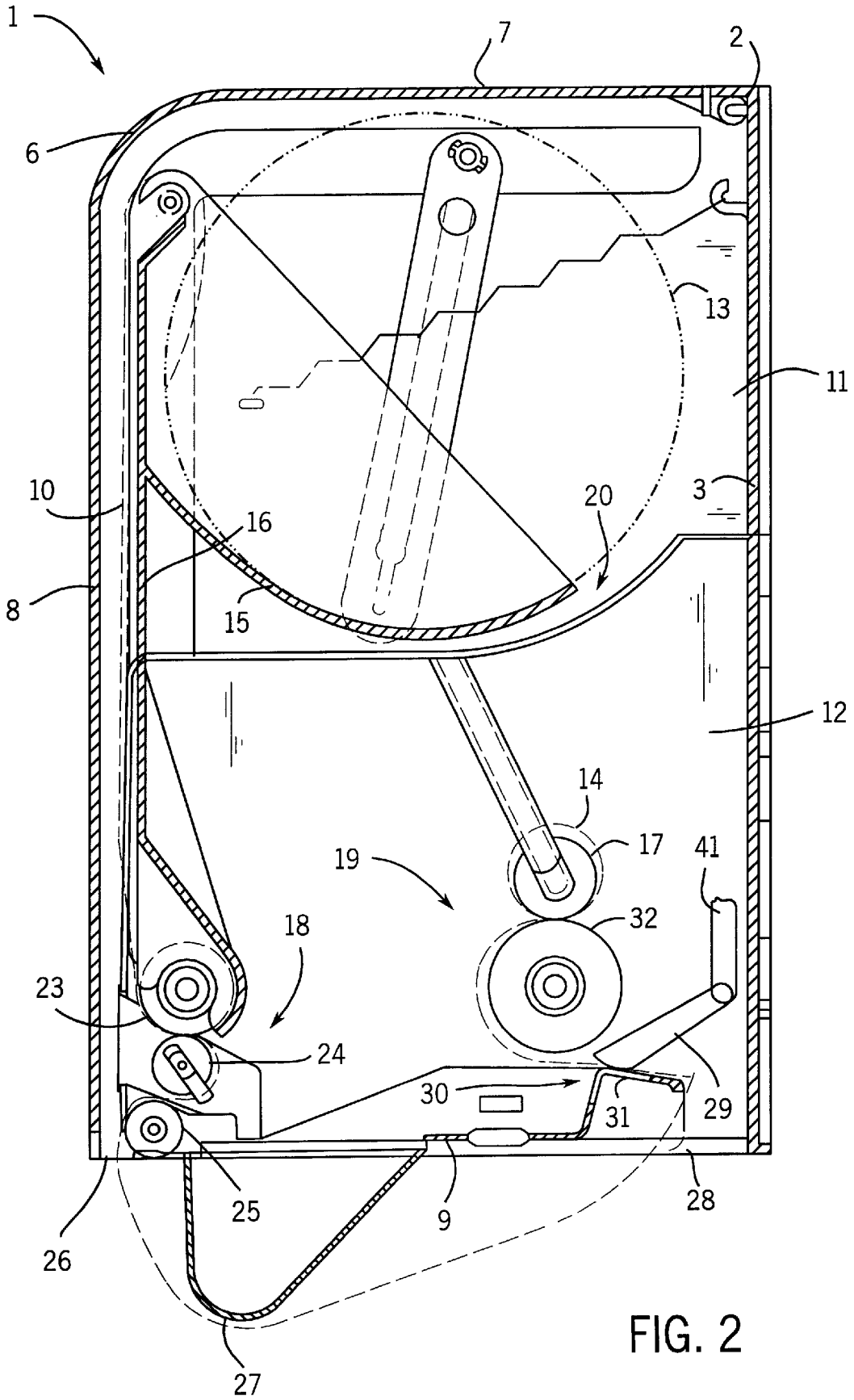
FIG. 2 is a vertical section through the dispenser of FIG. 1.
Figure 3:
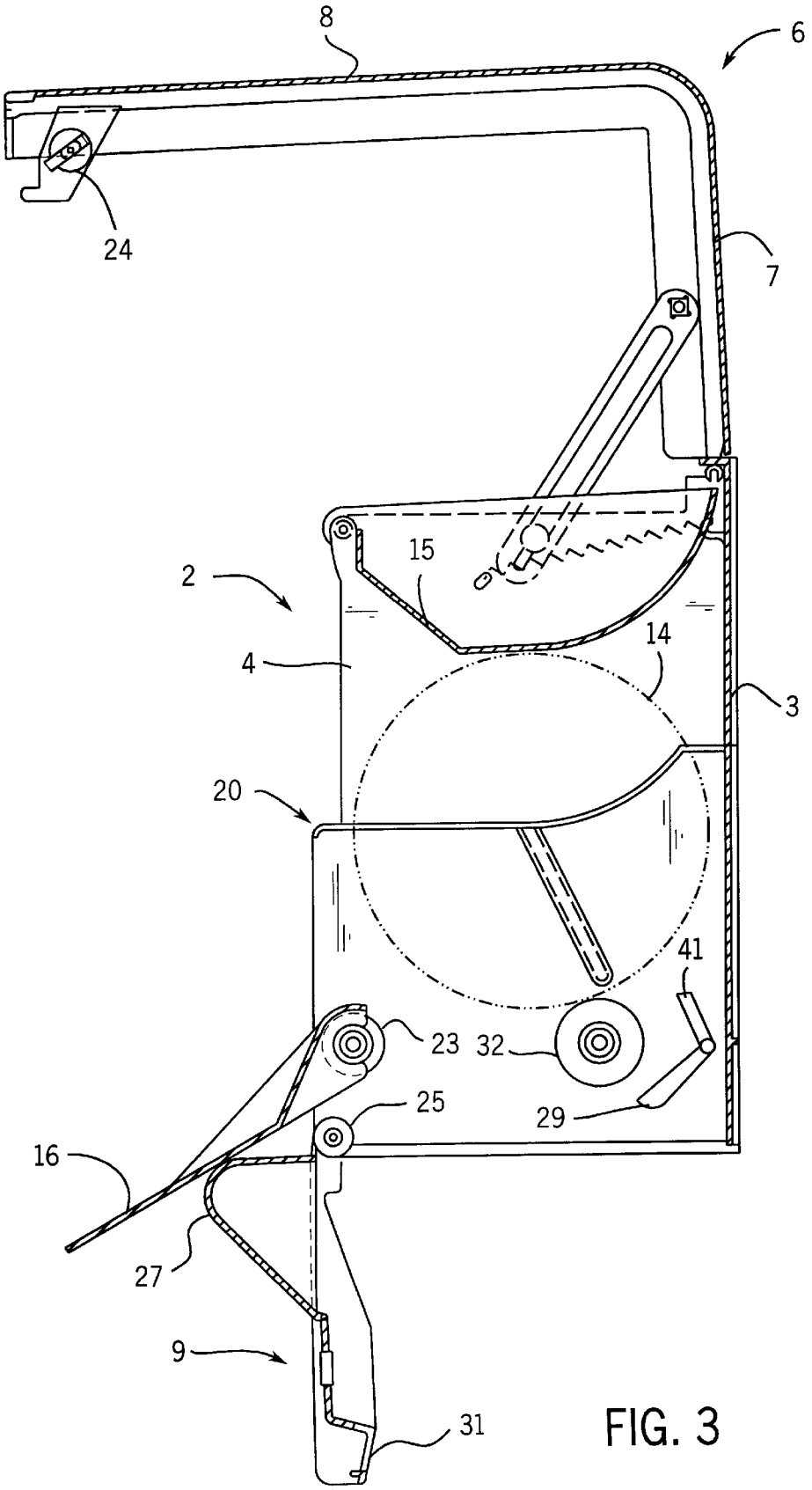
FIG. 3 shows the dispenser of FIG. 2, but in the opened condition.
Figure 4:
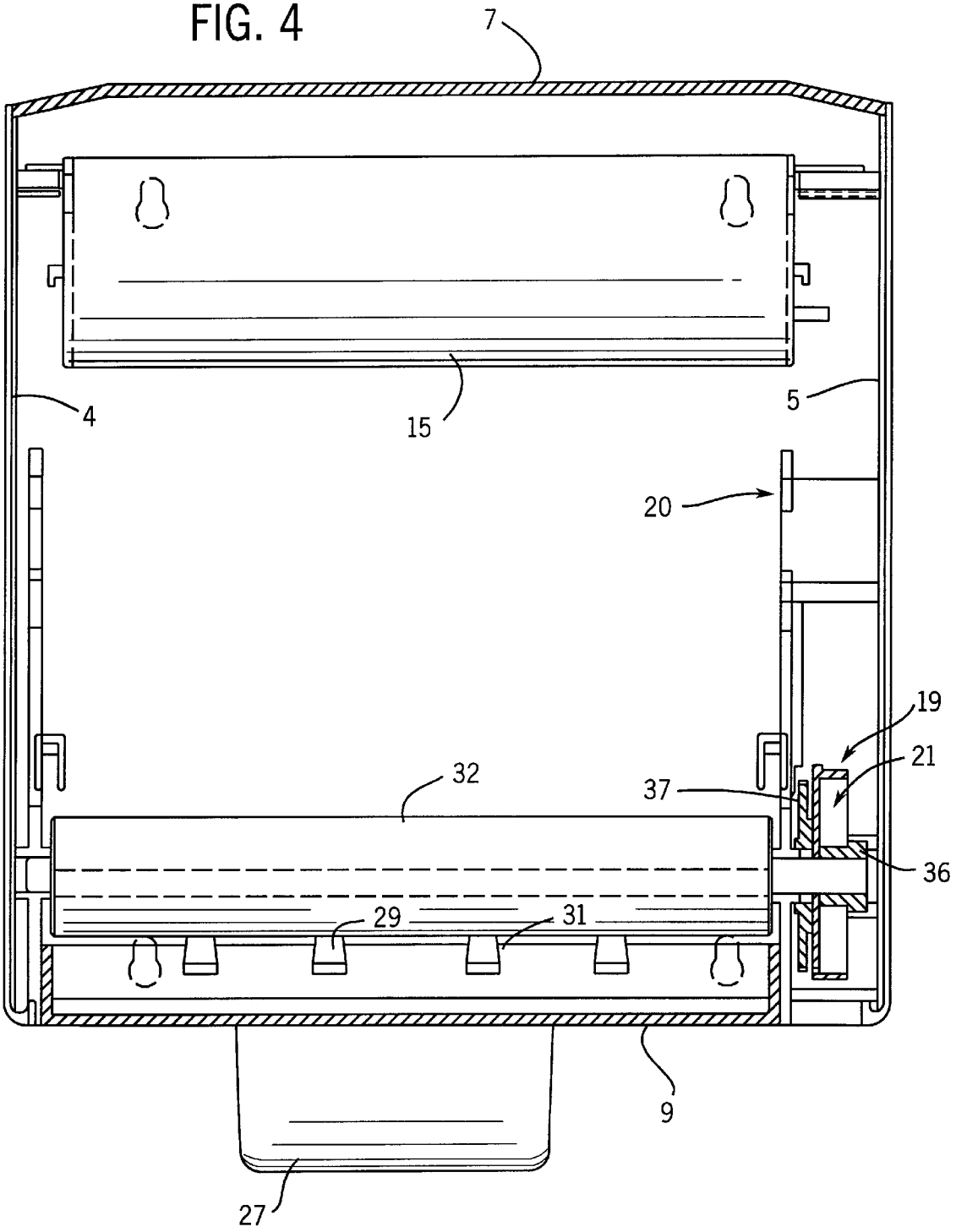
FIG. 4 shows the dispenser of FIG. 1 but in section roughly parallel to its front side.

The dispenser 1 comprises a base body 2 and a cover 6 which together form a substantially closed cabinet with walls located on the outer sides of the dispenser, of which the rear wall 3 and the side walls 4, 5 are formed substantially only by the integral base body 2, the cover wall 7 and the front wall 8 substantially only by the integral cover 6 and the bottom wall 9 substantially only by a further integral cover. From the closed position the cover 6 is to be swivelled roughly 90° upwards so that the cover wall 7 lies roughly in the plane of the rear wall 3, whereas the cover 9 is to be swivelled roughly 90° hanging downwards. Both covers may be hung in their swivel mounts for facilitated release non-destructively so that they are removable completely from the base body 2. The dispenser 1 serves to store, dispense and receive a toweling web 10 indicated by the dashed line in FIG. 2.

The upper part of the cabinet defines a clean space 11 adjoining the cover wall 7 and the directly adjoining downwards region defines a soiled space 12 extending down to the bottom wall 9. In the clean space 11 a clean roll 13 of wound clean toweling is arranged which is guided downwards from the cabinet and returned upwards into the cabinet where it is wound on a used roll 14 which is always located spaced away above the bottom wall 9 and spaced away below the roll 13. In operation, the rolls 13, 14 are shiftable in the up/down direction and are automatically lifted and opposingly shifted transversely as the roll 13 is reduced and simultaneously the roll 14 increased roughly corresponding to their change in diameter.

The clean roll 13 rests by its outer circumference in a tray-shaped carrier 15, on the bottom wall of which it slidingly turns on being dispensed and in which it is maintained centered by the sliding engagement. The web 10 is dispensed from the front side of the roll 13 upwards and then deflected in the topmost cabinet region downwards along the inner side of the front wall 8. A wall part of the carrier 15 adjoining the bottom lies roughly in the lowest position thereof approximately parallel to the front wall 8 and adjoins downwardly approximately the upper end of a partition 16 which likewise lies roughly parallel to the front wall 8 or vertical. As a result of this a chute closed off with respect to the spaces 11, 12 for guiding the web 10 is formed from the upper deflection approximately down to the bottom.

In the lowermost cabinet region the toweling web 10 on being dispensed actuates a dispensing mechanism 18 which serves for driving a take-up mechanism 19 by which the soiled web 10 is wound on a winding shaft 17 to become the roll 14. The shaft 17 is mounted shiftable in the up/down direction and rotatably. Both mechanisms 18, 19 are provided on a unit 20 separate from the cabinet and removable therefrom non-destructively, the movable function members of the unit—except for those serving to guide the web 10—are located on one side only of the cabinet or the unit 20, i.e. between their associated side cheek and the adjacent side wall 5. This applies also to an energy storage 21 which drives substantially all control/take-up movements so that the dispenser suffices with no electrical drive whatsoever. After dispensing a timing member 22 is engaged which after a predetermined time disengages again, thereby releasing takeup.

In the lowermost cabinet region and below the lowest position of the shaft 17 the web 10 to be dispensed is deflected through roughly 90° about a dispensing shaft 23 to the rear, then roughly 180° to the front about a countershaft 24 and finally again through roughly 90° about a deflector 25 downwards, the latter forming the rear definition of a slit-shaped dispensing opening 26 of the chute. The front definition is formed by the lower end of the front wall 8. From the opening 26 the front leg of the useful toweling loop runs downwards. The countershaft 24 mounted freely rotatable, tensioned in contact with the circumference of the dispensing shaft 24 is mounted at its ends on two inwardly protruding mounting cheeks of the front wall 8 or of the cover 6 so that it is lifted with the opening of the latter from the dispensing shaft 23. The inner ends of the mounting cheeks may form simultaneously latching members for arresting the cover 6 by the bottom wall 9 in the closed position.

In the take-up condition the useful loop is tensioned in contact by its top side with the underside of a loop contact 27 which is formed by a downward protrusion of the bottom 9 and is narrower than the web 10 so that the latter can be easily gripped on the side by hand on the underside of the dispenser 1 and pulled downwards. The rear leg of the loop is guided back into the cabinet through a take-up opening 28 adjoining the rear wall 3 and directly adjacent to this opening 28 the web 10 passes through a sensing means 30 which senses the presence of the web 10 in a passage gap. For this purpose a comb-like sensor 29 is in contact with the top side of the toweling web which in turn glides by its other side or underside roughly horizontally on a counter-member 31 which comprises engaging openings intimately adapted to the comb teeth of the sensor 29. If no web 10 is present, the sensor 29 is released, its comb teeth are moved downwards into the openings by an actuating force, e.g. of a spring, from which a control action is derived, namely e.g. blocking of the take-up mechanism 19, the energy storage 21 or the like.

The effect is the same when the bottom 9 with the counter-member 31 is moved away from the sensor 29, namely swivelled downwards, to open the complete underside of the cabinet and of the unit 20. The bottom 9 and the partition 16 may be mounted on the base body 2 or on the unit 20. The swivelling axis of the bottom 9 is expediently roughly coincident with the axis of deflection 25 which is likewise arranged on the unit 20. When the cover 6 is opened the partition 16 is swivable forwards and inclined downwards about an axis which roughly coincides with that of the dispensing shaft 23. In the opening position oriented inclined downwards the partition 16 can be locked in place by coming into contact with the protrusion 27 of the bottom 9 hanging freely downwards. In its working position the partition 16 is expediently locked in place by a spring latch.

After insertion of the roll 13 in the carrier 15, which can be lifted out of its mounting non-destructively, the web 10 is guided—with the partition 16 standing in its working position, but with the covers 6, 9 open—via the upper deflection downwards and about the cover 9, after which it is introduced with its winding shaft 17 carrying its free end from below upwards into the lower cabinet opening and inserted in the mounting for the winding shaft 17 from above downwards. The covers 6, 9 can then be closed one after the other. The rear edge of the cover 9 forms a deflection, leading to the sensing means 30, of more than 90° for the web 10 or the associated slot definition of the opening 28, so that on closing the cover 9 the web 10 is lifted against the sensor 29. On closing the cover 6 the countershaft 24 is brought into engagement with the dispensing shaft 23 from front to rear, the former due to its swivel travel engaging the dispensing shaft 23 with a radial tension which is initially higher and then lower when its working position is attained, so that a latched positioning materializes. Directly following the sensing means 30 directly adjacent to the opening 28 the web 10 is guided roughly 90° upwards about a motor-drivable take-up roller 32 which by its outer circumference is in friction contact with the outer circumference of the roll 15 by the force of the weight of the latter so that its rotary movement is transmitted to the roll 14. By closing the cover 9 the sensor 29 is lifted or actuated, as a result of which the take-up roller 32 is set in motion so that the roll 14 is turned until the useful loop is tensioned.

Located directly above the dispensing shaft 23 and driven directly by the latter sliplessly via a single gearing stage 34 the dispensing mechanism 18 comprises a rotor or wheel 33 which in its turn sliplessly drives via a single-stage belt drive 35 a take-up wheel 36 with translation which like the energy storage 21 lies roughly in the axis of the take-up roller 32 and carries the radial inner end of the spiral spring of the energy storage 21 so that via this two-stage geared connection the spring can be tightened. The other, outer end of the storage spring is defined with respect to a rotor or spring housing connected non-rotatably to the take-up roller 32 so that on exceeding a limiting torque with respect to the rotor it slips in idle motion. This rotor is drivingly connected via a front wall to a output wheel 37 which with respect to the winding wheel 36 is substantially larger, the former being coupled into the takeup movement of the roller 32, but not in rotation in the counter sense. The energy storage 21 is located axially between the wheels 36, 37, the freewheel axially or at the facing end between the storage 21 and the wheel 37, and the wheel 36 is located like the belt drive 35 and the wheel 33 directly adjacent the side wall 5. Via a multistage spur gear assembly 38, namely an idler gear and three translating gear stages, the wheel 37 drives a rotor or a braking wheel 39. The gearing 38 is located substantially above and behind the axis of the rotors 21, 32, 36, 37 and the axis of the brake wheel 39 is located approximately vertically above this axis so that it is provided in the uppermost region of the unit 20, whilst the rotors 21, 32, 36, 37 are located in the lowermost region of the unit 20 and the wheel 33 roughly halfway in the height thereof.

To enable the take-up mechanism 19 to be rendered motionless irrespective of the tension or presence of the toweling web at least one blocking means 40 is provided. Protruding upwardly from the side walls of the sensor 29 located roughly level with and behind the axis of the rotors 21, 32, 36, 37 directly adjacent the rear wall 3 is a brake lever 41 which at its upper end carries a friction brake member 42 and is non-rotatably connected to the sensor 29. The sensor 29 protrudes from its swivel shaft inclined downwardly at the front and in the opening, namely in the presence of the web 10 in the sensing means 30 the lever 41 extends roughly vertically upwards so that the blocking means 42 is lifted from the outer circumference of the brake wheel 39. As soon as the sensor 29 is released the brake lever 41 swivels by spring force against the brake wheel 39 which is defined by the blocking means 42 so that via the gearing 38 also the rotor 37 and via the freewheel the rotor of the energy storage 21 are defined against the tension release of the latter.

The control wheel 33 acts on a movable actuating or switching member, namely a control lever 43, which freely protrudes upwards from its lower swivel axis, extends over the major part of the height of the unit 20 and is located, on the one hand, between the axes of the rotors 23, 33 and, on the other, between those of the rotors 21, 32, 36, 37, 39 and the gearing 38. At the upper free end the lever 43 carries a suction pad 44 of the timing member 22 which is located opposite a fixed suction pad fitted to the base body or unit 20 so that the suction pads attain pressure-tight engagement by their upright pad edges on a swivel movement of the lever 43 to the rear. From the then closed pad space air is exhausted by the control movement of the lever 43 and the pad space is able to again draw in air via a reduced diameter orifice under the spring effect of the suction pads or a return spring engaging the lever 43 until the suction pad 44 is released and the spring returns the lever 43 into its starting or disengagement position.

Figure 5:
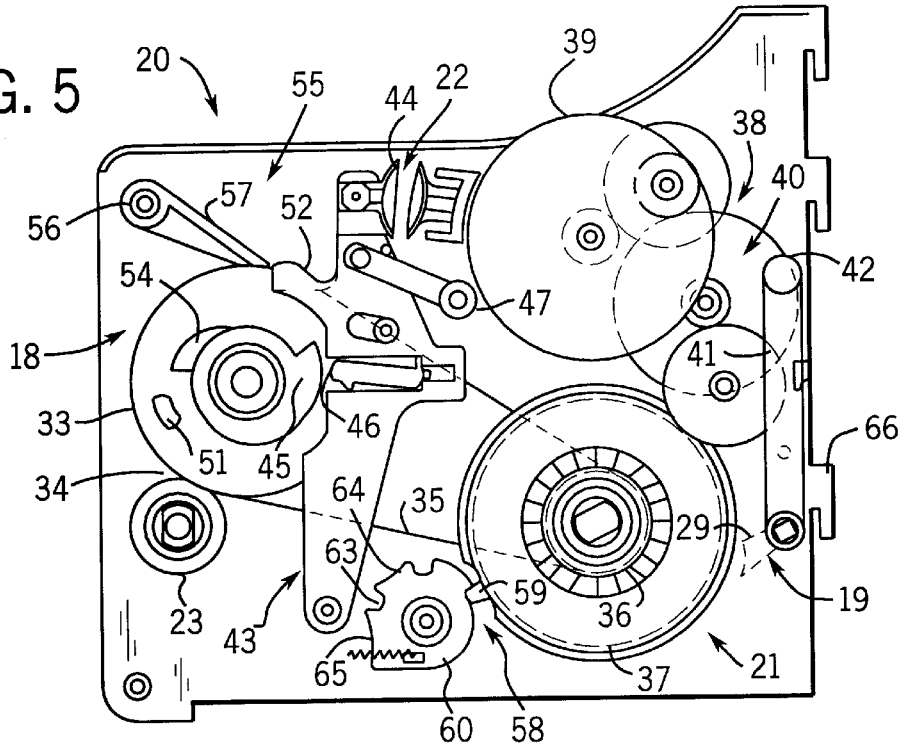
FIG. 5 shows the operating mechanism of the dispenser as viewed from the right as shown in FIG. 4 and in its resting position.
Figure 6:
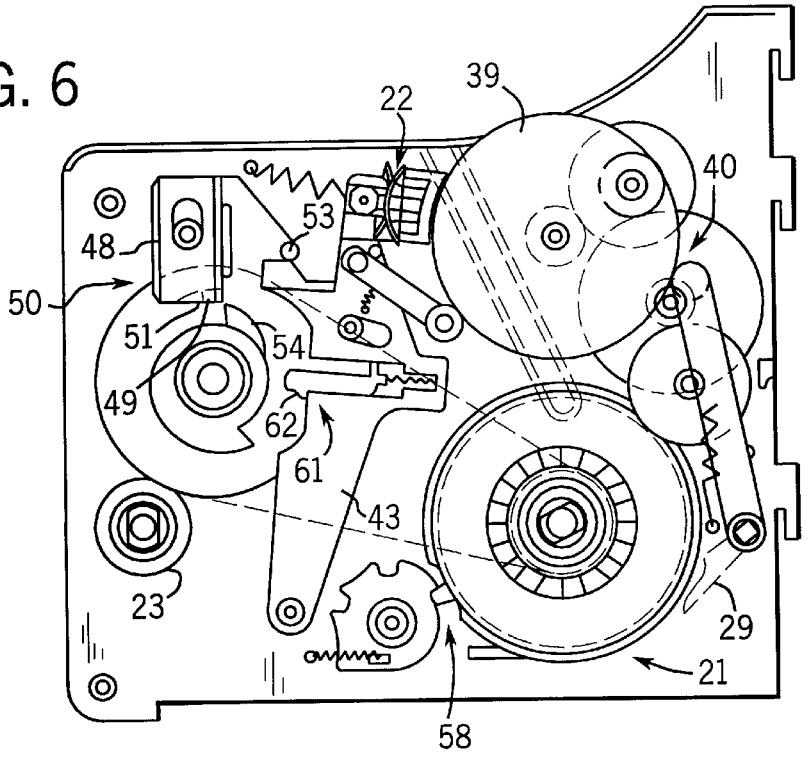
FIG. 6 shows the operating mechanism as evident in FIG. 5, but in the condition at the end of dispensing.

Roughly in the middle between the actuating member 22 and the swivel axis a control cam 45 describing an arc angle of practically 180° of the disc or wheel 33 engages the lever 43 so that the latter is translated once for every rotation of the wheel 33 into the engaging position of the timing member 22, the circumferential cam 45 thereby pressing against a cam follower 46 which is mounted to permit translation in the direction of this pressure transversely with respect to the lever 43 from its working position, shown in FIG. 6, into its disengaged position shown in FIG. 5. Closely adjacent to the timing member 22 between the latter and the cam follower 46 the loop 43 carries at a swivel lever oriented rearwardly a friction brake member 47 which when the timing member 22 is engaged pliantly yields in contact with the side of the outer circumference of the brake wheel 39 facing away from the brake member 42 and is then effective as described on the basis of the brake member 42. With the timing member 22 also the brake member 47 disengages and take up of the used loop occurs.

To limit dispensing of the web 10 from the clean storage 13 to e.g. several rotations of the dispensing roller 23, but to only a single rotation of the wheel 33 and thus to a prescribed dispensing length a limiting means 50 is provided which acts on one of the rotors, particularly wheel 33. On the base body of the unit 20, this base body composed of side cheeks and cross-members, comprising no walls transversely to the side cheeks, a locking member 48 is movably, particularly linearly shiftably mounted, limited by a stop in the up/down direction. This locking member is located substantially above the wheel 33 in front of the end of the lever 43 and carries at the lower end a stop 49 for the wheel 33. This wheel features at its facing end a cam 51, as a counterstop, which comes up against the stop 49 during dispensing, when the locking member 48 is engaged in its upper limit position, thus blocking further dispensing as well as positively blocking the take-up drive for the energy storage 21.

For engaging the stop 49 a cam control means is provided between the lever 43 and the locking member 48. The lever 43 features at the front side of its free end, roughly leve with the hinging movement of the brake member 47, a control cam 52 on which a cam follower 53 fixedly arranged on the locking member 48 is guided. On engaging movement of the timing member 22 the stop 49 is translated via the cam follower 53 into its stop position. On release of the timing member 22 and return of the lever 43, also movably stop-limited, the cam follower 53 is again released and the stop 49 drops back into its disengaged position under the force of the weight of the locking member 48. Limiting is thus achieved by the lever 43 being engaged via the cam control means 45, 46 and in turn the stop 49 being engaged.

The limiting means 50 also works, however, when the timing member 22 or the lever 43 is not provided. For this purpose the wheel 33 carries a further control cam 54 in a plane which is offset with respect to the cam 45 as well as being roughly diametrally opposed with respect to the latter, which has a steeper slope than the cam 45 and in the movement path of which a cam follower, e.g. a running surface of the stop 49 located transversely to the stop surface. Accordingly, on every rotation of the wheel 33 the control cam 54 thereof is able to translate the locking member 48 directly once into its engaging position, directly before the cam 51 is stopped.

So that the energy storage 21, e.g. in the presence of no toweling 10, is not untensioned via a return movement of the dispensing mechanism 18, a return lockout 55 is provided which expediently directly affects the wheel 33 or the operating status thereof. The lockout 55 comprises movably or swivably mounted in a mount 56 above the wheel 33 a locking means such as a locking lever 57 extending from the mount 56, the free end of which is configured as a locking pawl engaging a locking toothing in the sense of freewheel. The locking member 57 is located between the locking member 48 and the outer side of the associated mounting cheek. For the locking position the lever 57 is loaded by an actuating force, more particularly merely by the force of the weight. This locking pawl has in the return direction a minor clearance which, for instance, may be provided as a linear diametral clearance in the mount 56. In dispensing rotation of the wheel 33 the locking lever 57 is included in the movement by its friction with respect to the locking surfaces or the locking toothing stop-limited by the corresponding end of this clearance. Once the dispensing action is ended and thus the toweling web released from the manual tensioning, the energy storage 21 drives the wheel 33 in the return direction via the wheel 36. The latter coupling the engaging locking lever 57 into the movement up to the other end of the clearance before the locking occurs.

In its working position the cam follower 46 is locked to a latching means 61, e.g. a latching nose 62 located directly behind its running surface, which clasps a latching shoulder of the lever 43. In this position the elongated pin-shaped cam follower 46 or the latch 62 is movable transversely to its working movement, namely transversely to its longitudinal direction with respect to the lever 43, i.e. in a direction corresponding to the return direction of the wheel 33 or of the cam 45. Due to this return movement the latch 62 is released and the cam follower 46 can be translated linearly into a resting position in the sense of the cam 45 being lifted with respect to the lever 43.

If the wheel 33 has failed to execute a complete dispensing rotation up to stopping of the cam 51 and thus the cam 45 remains in pressure contact with the cam follower 46, the cited minor return travel of the cam 45 due to its friction engagement with the cam follower 46 results in it being unlatched, i.e. directly after the timing member 22 and the brake member 47 have engaged. When the timing member is then disengaged, the return movement of the lever 43 and the disengagement 47 is not obstructed, despite the cam 45 being in contact with the cam follower 46, because the cam follower 46 in this case is able to deviate contrary to the spring force acting on it, it namely being shifted rearwardly with respect to the lever 43 in a mounting pocket. When the control cam 45 is turned further and away from the cam follower 46 by further dispensing of the toweling web 10, then the cam follower 46 is again released and the spring urges it into its working position in which it drops by the force of its own weight so that the latch 62 reengages the latching shoulder, thus reinstating the latch.

Due to the take-up mechanism 19 only as much toweling length is taken up in each case as is expedient for returning also a partial length of that taken up into the useful loop on subsequent dispensing so as to feed the toweling web for use as fully as possible. To limit this dispensing of the taken-up toweling web a return lock 58 is provided which expediently acts on the rotor of the energy storage 21 or on the take-up roller 32 directly. For instance, the return lock 58 may limit dispensing to two or three turns of the take-up roller 32, these turns being oriented opposite to that of take-up. The return lock 58 may operate as a kind of Maltese cross mechanism and features at the outer circumference of the rotor in a recess a toothed cam 59 which protrudes radially beyond the bottom of the recess slightly more than the remaining continuous, circular outer circumference of the rotor which is interrupted solely by this recess.

Between the lever 43 and the rotor, in the lowermost region of the unit 20, a disk-shaped control body 60 is rotatably mounted which comprises, as a kind of Maltese cross, on its outer circumference a number of engaging gaps 62 corresponding to the number of desired return rotations, closely adapted to the tooth 59. Between adjacent gaps 63 radially protruding holding surfaces 64 forming circumferential surfaces are provided on which the continuous circumference slides when the tooth 59 runs remote from the control body 60 so that the latter is safeguarded against control movements. In the direction of its control movement the control body 60 is loaded by a spring. If the tooth 59 in the return movement is moved counter-clockwise in accordance with FIGS. 5 and 6 it releases the first holding cam 64 at its associated flank, the control body 60 turns a little bit clockwise due to the spring force and then the circumferential surface of the rotor engages the holding surface 64 so that further rotation of the control body 60 is prevented until the tooth 59 passes through the next gap 63, again releasing this by the effect as cited and then the next holding surface 64 taking over the rotary lock.

Following the last gap 53 is a locking surface 65 against which the tooth 59 runs on the last or third return rotation so that the return or take-up roller 32 is positively locked dimensionally from further return rotation. On the next take-up rotation the tooth 59 steps the control body 60 corresponding inversely from gap to gap 63 back into the starting position. If the number of take-up rotations is more than those of return rotations the control body 60, on attaining the starting position, is locked therein in the manner as described by the circumferential surface of the rotor. The return rotation also results in the spring of the energy storage 21 being tensioned, so that tensioning results simultaneously from both the dispensing roller 23 and the take-up roller 32.

The movable function members in accordance with FIGS. 5 and 6, for instance the individual gearing stages and cam controls, are thus arranged in different planes, each directly adjacent to the other on the outer side of the associated mounting cheek so that they can be accommodated very closely spaced and result in the cabinet being widened to only a very minor extend with respect to the sensor 29 could also be formed by a roller, e.g. the take-up roller, particularly when this is provided separate from a roller driving the roll 14. The mounting cheeks feature on the rear side of the unit hook-shaped fastening members 66 so that when the cabinet is open the unit 20 can be removed from the base body 2 merely by being lifted slightly to the front, and also reinserted in place vice-versa. The fastening members 66 engage openings in the rear wall 3, beyond the outer side of which contact protrusions extend, with which the dispenser is to be secured to a wall in contact therewith. If the wound roll 14 needs to be removed, it can be removed from the top from its connection to the unit 20, where necessary, including the carrier 15 by contact, lifting out and removing to the front from the base body 2. It is also contemplatable to take up the toweling web initially without winding on the roll 14 and to buffer-store it in a separate space until this part of the towel is wound delayed in time. During this time this portion of the towel may dry and e.g. may be deposited in the protrusion 27 formed in the cabinet which is then expediently roughly the same in width as the web 10. This space may also be opened by opening the cover 9. Instead of being mounted swivable the carrier 15 may also be mounted practically linearly shiftable.

What is claimed is:

1. A towel dispenser for manually transferring a toweling web in a downstream direction while providing an accessible web loop having a bottommost portion connecting to web ends of the toweling web, the web ends including a rear end downstream of the bottommost portion and a front end upstream of the bottommost portion, the towel dispenser comprising:

retracting means for positively drawing the web loop downstream and towards an interior of said towel dispenser, said retracting means being manually driveable and including energy storing means for storing a retracting energy for operationally drawing the toweling web in the downstream direction when the web loop is shortened, blocking means for positively preventing the retracting energy from being delivered, said blocking means being operable to achieve a blocking state preventing said retracting energy from being delivered and a release state permitting said retraction energy to be delivered, operating means for operating said blocking means in a plurality of dispenser states, said dispenser states including a loading state for making the toweling web accessible beyond the web loop, and an end state in which said rear web end has arrived at a sensing point where the toweling web is drawn downstream of the bottommost portion of the web loop and towards the interior of said towel dispenser, and control means for operationally controlling said operating means, said control means including web sensing means for directly sensing the toweling web at said sensing point located downstream of the bottommost portion, said sensing means transferring the blocking means to the blocking state when said dispenser achieves at least one of said dispenser states.

2. The towel dispenser according to claim 1, and further including at least one web store for receiving a retracted section of the toweling web, wherein said rear web end is a trailing end of the stored section, wherein said web sensing means includes a web sensor directly touching the toweling web, and wherein charging means are included for charging said energy storing means with manual energy and for transforming the manual energy to achieve said retracting energy as stored by said energy storing means.

3. The towel dispenser according to claim 1, wherein mechanical time deferring means are provided for delaying a drawing up of the web loop after the web loop has been manually drawn out of said dispenser.

4. The dispenser according to claim 1, wherein at said sensing point said web sensing means include a sensing gap for receiving the toweling web and defining a median gap plane, said sensing gap being bounded by a web sensor directly contacting the toweling web when traversing said sensing gap and synchronously transferring said blocking means to said blocking state when said toweling web is absent from said sensing gap.

5. The towel dispenser according to claim 1, wherein said retracting means include a multi-wheel gear assembly, said gear assembly including said energy storing means, said energy storing means including a spring store and overtension prevention means for preventing malfunction caused by overtensioning said spring store, said gear assembly including a fluid damped output wheel, said blocking means including a brake member for directly engaging said output wheel upon operation of said control means, said retracting means being driven by said spring store for collecting a soiled loop section of the toweling web downstream.

6. The towel dispenser according to claim 5, further including an outermost backside, an outermost front side remote from said back side, a rear half extension connecting to said back side and a frontal half extension connecting to said front side, said spring store and said output wheel being located substantially within said rear half extension.

7. The towel dispenser according to claim 1, wherein said energy storing means includes energy storing unit, said retracting means including a retracting runner for positively pulling the toweling web from the loop downstream into said towel dispenser, in at least one positioning said retracting runner and said energy storing unit being oriented substantially coaxial.

8. A towel dispenser for manually transferring a toweling web to provide an accessible web loop connecting to web ends of the toweling web, the web ends including a rear end and a front end, the towel dispenser comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, and including a web guide for guiding the toweling web against motions transverse to a web plane, a guide member bounding said web guide on one side of said web plane, said web sensor being displaceable through said web plane and including a mechanical sensor for slidingly engaging the toweling web under a contact pressure.

9. A towel dispenser for manually transferring a toweling web to provide an accessible web loop connecting to web ends of the toweling web, the web ends including a rear end and a front end, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, and drive means for positively loading said energy storing means including an energy storing member, said drive means including an input runner manually driveable by pulling the toweling web away from said towel dispenser and into the web loop, said drive means including a drive gear driveably connecting said input runner directly with said energy storing member, a pulled length section of the toweling web being defined when the toweling web is manually pulled away from said towel dispenser, a stored energy unit being defined by that amount of energy stored by said energy storing member which is needed for retracting the pulled length section back to said towel dispenser, from said input runner to said energy storing member said drive gear defining a gear ratio of at the most 1:2, thereby per pulled length section said energy storing member being loaded by more than said stored energy unit.

10. The towel dispenser according to claim 9, wherein said input runner directly drives a gear runner at a reduction ratio, said gear runner directly driving said energy storing member via a drive belt and a belt wheel substantially coaxial with said energy storing member.

11. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, and mechanical time deferring means for delaying the web loop from being drawn up after the web loop has been manually drawn out of said dispenser, and stopping means for positively locking said retracting means when the toweling web is manually pulled away from said towel dispenser and into the web loop while said towel dispenser is in a state different from said dispenser states, and stopping means being releasingly operated by said mechanical time deferring means, said retracting means including a fan wheel for controlling retraction velocity of said retracting means, said fan wheel including a first stopping member of said stopping means, and a second stopping member of said stopping means being located on a side of said first stopping member which side is remote from said blocking means.

12. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, mechanical time deferring means provided for delaying the web loop to be drawn back after the web loop has been manually drawn out of said dispenser, and limiting means for positively limiting a pulled length section of the toweling web when the toweling web is manually pulled away from said towel dispenser, said limiting means including cam control means, a control disc, a locking shifter for positively but releasably locking said control disc when said locking shifter is in a locking state, said cam control means further including an actuating lever operated by a radially pitching cam of said cam control means and by a time deferring unit of said mechanical time deferring means, thereby in operation said cam moving said actuating lever to a start position of said time deferring unit which releases said actuating lever after a time unit, when released said actuating lever releasing said locking shifter via a cam curve.

13. The towel dispenser according to claim 12, wherein said time deferring unit includes first and second sucker pads, said second sucker pad being displaceable with respect to said first sucker pad commonly with said actuating lever, when said actuating lever is in said start position said second sucker pad being adhesingly connected to said first sucker pad by vacuum only during said time unit.

14. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, and limiting means for positively limiting a pulled length section of the toweling web when the toweling web is manually pulled away from said towel dispenser, said limiting means including cam control means including a control disc in drive connection with said energy storing means, a radial cam on said control disc and a locking shifter for positively locking and releasing said control disc, for locking said control disc said locking shifter being directly operable by said radial cam.

15. The towel dispenser according to claim 14, wherein said cam control means include three cams including said radial cam, a second cam on said control disc and a third cam on an actuating lever operating said locking shifter, said second control cam operating said actuating lever and said third cam directly operating said locking shifter, thereby said radial cam and said second cam providing actuating members for alternately operating said locking shifter.

16. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, mechanical time deferring means provided for delaying the web loop to be drawn back after the web loop has been manually drawn out of said dispenser, and said retracting means include cam control means operating said mechanical time deferring means, said cam control means including first and second cam members interengaged when transferring said mechanical time deferring means to a start position, said first cam member being driven by the toweling web and said second cam member being mounted on an actuating member of said mechanical time deferring means, discoupling means being provided for discoupling said cam members when said mechanical time deferring means 1st transferred to said start position and when simultaneously said first cam member stops while still engaging said second cam member.

17. The towel dispenser according to claim 16, wherein said second cam member is displaceably mounted on said actuating member to be moved from a coupling position to a discoupling position by a short return motion of said first cam member, over said short return motion said first cam member being driven by said energy storing means.

18. The towel dispenser according to claim 17, wherein said short return motion is limited by return stop means.

19. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, mechanical time deferring means provided for delaying the web loop to be drawn back after the web loop has been manually drawn out of said dispenser, and said control means include an actuating member, a locking shifter and a control runner drivingly connected with said energy storing means, said actuating member including a cam curve for operating said locking shifter which is tensioned towards an unlocking state, said locking shifter including a stop and said control runner including a counterstop for abutting against said stop when said locking shifter is not in said unlocking state, said actuating member further including a timing member of said mechanical time deferring means, a brake member for preventing said energy storing means from being unloaded from energy, and a cam follower actuated by said control runner for actuating said actuating member and said mechanical time deferring means when the toweling web is manually pulled away from said towel dispenser.

20. The towel dispenser according to claim 19 and further including a pull-out roller directly driven by the toweling web when manually pulled away from said towel dispenser, wherein said pull-out roller directly engages and drives said control runner via a single-stage gear drive, said locking shifter being located on a side of said control runner remote from said gear drive with respect to an imaginary straight line interconnecting said gear drive and said locking shifter said actuating member being located laterally offset.

21. The towel dispenser according to claim 20 and further including a retracting runner of said retracting means, wherein a first functional group is defined and includes said control runner, said gear drive, said locking shifter and said actuating member, a second functional group being defined and includes said retracting runner, a fan wheel and said blocking means, said first functional group being located laterally substantially directly juxtaposed to said second functional group.

22. The towel dispenser according to claim 21 and further including a dispenser casing subdivided in superimposed first and second casing spaces, said first casing space being a reception for a clean toweling roll, containing the toweling web, said first casing space being located above said second casing space providing a reception for a used toweling and filled with the toweling web by said retracting means, within said dispenser casing at least one partition wall being provided for separating said first casing space from said second casing space, said retracting means being located substantially entirely below said first casing space.

23. The towel dispenser according to claim 22, wherein said partition wall includes a reception tray for receiving the clean toweling roll, with respect to said dispenser casing said reception tray being displaceable in an elevation direction, spring means being provided for steadily rising said reception tray as the clean toweling roll decreases when the toweling web is dispensed.

24. The towel dispenser according to claim 22, wherein the clean toweling roll defines a maximum roll diameter when the toweling web is entirely contained in the clear toweling roll, said first casing space defining a first high extension and said second casing space defining a second high extension, a total extension being defined by a sum of said first and second height extension, said total extension being smaller than twice said maximum roll diameter, both said first and second height extensions being reciprocally variable.

25. The towel dispenser according to claim 22 and further defining a back side of said dispenser casing, wherein said partition wall is displaceably mounted to thereby elevate towards said back side.

26. The towel dispenser according to claim 22, and further including at least one web store for receiving a stored section of the toweling web, wherein said at least one web end being a trailing end of the stored section, said web sensing means including a web sensor directly touching the toweling web, and a dispenser casing bounding a casing space for receiving said web store with the toweling web closely packed, said dispenser casing being penetrated by an external web outlet, said web store and said web outlet being interconnected by a shaft duct through which the toweling web is conveyed when the toweling web is successively delivered through said web outlet and out of said web store, means being provided for opening substantially said shaft duct substantially over an entire duct length extension without destruction.

27. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, and a web guide, a storing space for receiving closely packed length sections of the toweling web and a web dispensing outlet manually accessibly freeing the toweling web, said web guide connecting said storing space with said web dispensing outlet, said web guide being bounded by opposing guide members including a rear guide member located on a rear side of said web guide while separating said storing space from said web guide, for opening said storing space said rear guide member being displaceable in a downward direction.

28. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, and said sensing gap being bounded by a web sensor, and an outermost front cover displaceably mounted for opening said towel dispenser, the web loop including frontal and rear loop legs, said frontal loop leg directly connecting to a guide gap for guiding the toweling web, said guide gap being bounded by gap members including at least one deflection member for deflecting the toweling web within said guide gap, at least one of said gap members being mounted on said front cover for opening said guide gap commonly with displacing said front cover.

29. The towel dispenser according to claim 28 and further including at least one cover wall, each of said gap members defining an individual deflection axis and an individual deflection radius, wherein at least one of said cover wall is pivotable about a pivot axis located close to said individual deflection axis of at least one of said gap members, said pivot axis being spaced from at least one of said individual deflection axis by less than said individual deflection radius of at least one of said gap members.

30. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, at least one web store for receiving a stored section of the toweling web, wherein said at least one web and being a trailing end of the stored section, said web sensing means including a web sensor directly touching the toweling web, and a lowermost bottom shield bearing a web guide face for slidingly guiding the toweling web, said web store being provided for receiving a holder for holding a closely packed length section of the toweling web, said bottom shield operably closing a passage opening, when opened said passage opening is wide enough for inserting said holder into said towel dispenser and for operationally mounting said holder to said towel dispenser.

31. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, at least one web store for receiving a stored section of the toweling web, wherein said at least one web and being a trailing end of the stored section, said web sensing means including a web sensor directly touching the toweling web, and a lowermost bottom section located spacedly below a lowermost storing zone of said at least one web store said bottom section including a freely exposed protrusion for abuttingly receiving the web loop while retracted by said retracting means, for giving bottom access to an inside of said dispenser said bottom section commonly with said protrusion being displaceable into an opened position.

32. A towel dispenser for manually transferring a toweling web to provide an accessible web loop connecting to web ends of the toweling web, the web ends including a rear end section and a front end section, comprising:

retracting means for positively drawing the web loop towards said towel dispenser, said retracting means being manually driveable and including energy storing means for storing a retracting energy, blocking means for positively preventing the retracting energy from being delivered, said blocking means being operable to achieve a blocking state and a release state, operating means for operating said blocking means in a plurality of dispenser states, said dispenser states including a loading state for making the toweling web accessible beyond the web loop, and an end state in which one of said web ends has arrived near the web loop, control means for operationally controlling said operating means, said control means including web sensing means for directly sensing the toweling web and for transferring the blocking means to the blocking state when said dispenser achieves at least one of said dispenser states, said web sensing means including a sensing gap for displaceably receiving the toweling web, said sensing gap being bounded by a web sensor, at least one web store for receiving a stored section of the toweling web, wherein said at least one web and being a trailing end of the stored section, said web sensing means including a web sensor directly touching the toweling web, and a limiting ratchet for limiting dispensing of the toweling web, said web store including a storing space into which said retracting means retract the toweling web, said limiting ratchet permitting but limiting said dispense out of said storing space and into the web loop, said retracting means including a retracting runner operationally movable in opposing directions, said limiting ratchet including a locking member movable in opposing step motions, said locking member being actuated by said retracting runner to perform said opposing step motions.

* * * * *

UNITED STATES PATENT AND TRADEMARK OFFICE

CERTIFICATE OF CORRECTION

PATENT NO. : 5,820,231

DATED : October 13, 1998

INVENTOR(S) : Ralph Schön

It is certified that error appears in the above-identified patent and that said Letters Patent is hereby corrected as shown below:

Column 8, line 16, "leve" should be --level--.

Column 9, line 49, "62" should be --63--.

Claim 17, line 4, "discoupling" should be --decoupling--.

Signed and Sealed this

Sixth Day of April, 1999

*Attest:*

*Attesting Officer*

Q. TODD DICKINSON

*Acting Commissioner of Patents and Trademarks*